US006065249A

United States Patent [19]

Gephart et al.

[11] Patent Number: 6,065,249

[45] Date of Patent: May 23, 2000

[54] PANEL DOOR WITH LARGE WIDTH GASKETLESS FRAME

[75] Inventors: John D. Gephart, Rocky Hill, Conn.; Robert J. McBean, Acton, Canada

[73] Assignee: The Stanley Works, New Britain, Conn.

[21] Appl. No.: 09/072,098

[22] Filed: May 4, 1998

[51] Int. Cl.[7] ..... E05D 13/00

[52] U.S. Cl. ..... 49/425; 49/504; 49/501

[58] Field of Search ..... 49/425, 504, 501; 52/204.597, 204.71, 716.8, 800.14

[56] References Cited

U.S. PATENT DOCUMENTS

| | | | |
|---|---|---|---|
| 1,045,580 | 11/1912 | McClellan | 52/204.597 |
| 2,205,519 | 6/1940 | Eiber et al. . | |
| 2,576,348 | 11/1951 | Kinghorn . | |
| 2,659,939 | 11/1953 | Greig | 49/425 |
| 2,798,261 | 7/1957 | Greig . | |
| 2,798,262 | 7/1957 | Beamer . | |
| 3,112,534 | 12/1963 | Winnan | 52/204.599 |
| 3,214,879 | 11/1965 | Ellington, Jr. et al. . | |
| 3,426,482 | 2/1969 | Mock . | |
| 3,744,827 | 7/1973 | Cox | 403/24 |
| 3,750,337 | 8/1973 | Brydolf et al. | 49/411 |
| 3,784,043 | 1/1974 | Presnick . | |
| 3,824,753 | 7/1974 | Anderson . | |
| 3,838,548 | 10/1974 | Tanner | 52/656.4 |
| 3,866,373 | 2/1975 | Hudock . | |
| 3,879,912 | 4/1975 | Cox . | |
| 4,193,500 | 3/1980 | Scott | 206/577 |
| 4,335,552 | 6/1982 | Blanchett et al. . | |
| 4,407,099 | 10/1983 | McLaughlin . | |
| 4,631,894 | 12/1986 | Jerila . | |
| 4,722,150 | 2/1988 | Jacobs et al. | 49/425 |
| 4,747,248 | 5/1988 | Fahs . | |
| 4,850,145 | 7/1989 | McAfee | 49/501 |
| 4,884,371 | 12/1989 | Gagnon | 49/501 |
| 5,237,785 | 8/1993 | Lukes . | |
| 5,349,783 | 9/1994 | Jasperson et al. | 49/425 |
| 5,473,853 | 12/1995 | Guillemet et al. . | |
| 5,598,606 | 2/1997 | Jacobs | 16/93 R |
| 5,673,516 | 10/1997 | Hughes et al. | 49/425 |
| 5,860,264 | 1/1999 | Gephart et al. | 52/656.4 |

*Primary Examiner*—Daniel P. Stodola
*Assistant Examiner*—Gregory J. Strimbu

[57] ABSTRACT

A panel door comprises a rectangular panel, a pair of metallic stiles and a pair of metallic rails. The edge portions of the panel are received in the stiles and rails, and corner connectors join the ends of the stiles and rails. The stiles and rails are each integrally formed of sheet metal with front, rear, outer and inner faces, and the front faces are of greater transverse dimension than the rear faces. The rear walls of the stiles and rails are, prior to insertion of the panel thereinto, inclined towards the front walls and are resiliently deflected upon insertion of the panel to provide a biasing force to seat the panel snugly in channels formed between the front and rear walls.

15 Claims, 4 Drawing Sheets

PANEL DOOR WITH LARGE WIDTH GASKETLESS FRAME

BACKGROUND OF THE INVENTION

The present invention relates to mirror and like panel doors, and, more particularly, to a relatively large width sheet metal gasketless frame for receiving the edges of mirrors and other planar panels.

Mirrors or doors with mirrors on a face thereof are widely employed in bedrooms, bathrooms, wardrobes and dressing rooms to enable viewing of attire by the wearer, to enhance the appearance of rooms, or to provide special effects. In some instances, the mirror itself comprises a sliding panel, but preferably its periphery is seated in a peripheral frame for uses such as a sliding shower or wardrobe door. Such frames are commonly aluminum extrusions although sheet metal is also formed to provide some frame elements.

In gasketless frames, the structure is usually formed with one or more deflectable portions which are resiliently deflected by the panel as it is inserted thereinto and these portions apply a biasing force to retain the panel snugly seated therein.

Generally, sheet metal frames offer advantages from the standpoint of cost and ease of varying the appearance. However, as the width of the frame members is increased for aesthetic or functional considerations, the clamping force is generally decreased or difficult to control.

Accordingly, it is an object of the present invention to provide a panel door with a relatively wide gasketless frame of formed sheet metal which retains the panel securely therein.

It is also an object to provide such a simple and rapid assembly of the door.

Still another object is to provide novel framing element for such a frame which may be readily and economically fabricated and which produce a long lasting and rugged assembly.

SUMMARY OF THE INVENTION

It has now been found that the foregoing and related objects can be readily attained in a panel door comprising a generally rectangular panel, a pair of metallic stiles receiving the side edge portions of the panel, a pair of metallic rails receiving the top and bottom edge portions of the panel, and corner connectors joining the ends of the stiles and rails. The stiles and rails are integrally formed of sheet metal with front, rear, outer and inner faces, and the front faces of the stiles and rails are of greater transverse dimension than the rear faces thereof.

The stiles have an outer wall constituting the outer face and front and rear walls extending inwardly therefrom which constitute the front and rear faces. The rear wall has, seriatim, (i) a substantially planar base portion extending in a plane generally perpendicular to the outer wall, (ii) an offset portion extending generally perpendicularly to the plane of the base portion and towards the front wall, (iii) an intermediate portion extending angularly away from the front wall towards the plane of the base portion, and (iv) a face portion extending in the plane of the base portion. The stiles also have an inner wall portion at the end of the face portion of the rear wall with a face section which extends generally perpendicularly to the plane of the base and face portions thereof and towards the front wall. A flange on the face section of the inner wall portion extends towards the front wall and is angled towards the outer wall.

The front wall has, seriatim, (i) a base portion extending in a plane generally perpendicular to the outer wall, (ii) a concave portion extending towards the rear wall, and (iii) a face portion extending in the plane of the base portion. Each stile also has an inner wall portion at an end of the face of the front wall portion with a face section which extends generally perpendicularly to the plane of the face and base portions and towards the plane of the rear wall face and base portions. The face section of the inner wall portion has a flange extending generally perpendicularly thereto and towards the outer wall.

The inner wall portion of the front wall and the concave portion on the front wall cooperate with the flange on the inner wall portion of the rear wall and the intersection of the rear wall offset and intermediate portions to define a channel therebetween in which the peripheral portion of the panel is seated. The rear walls of the stiles and rails resiliently bias the edge portions of the panel against the front walls of the stiles and rails.

Preferably, the outer walls of the stile has an inwardly extending abutment provided by a reversely bent portion intermediate its width, and the abutment is substantially aligned with the flange of the inner wall portion on the front wall. The panel abuts this abutment which prevents rotational movement of the stiles relative to the panel. The outer wall also desirably has an inwardly offset portion adjacent the abutment upon which the panel seats, and the abutment has an upper section which is inclined towards the front wall.

Desirably, the concave portion of the front wall of the stile has an undulating section adjacent the face portion thereof, and the front wall has an arcuate transitional section between the face portion and the inner wall portion.

The rails also have an outer wall and front and rear walls extending inwardly therefrom. The rear wall has, seriatim, (i) a face portion extending in a plane generally perpendicular to the outer wall and (ii) an inner wall portion inclined towards the front wall and outer wall. The front wall has, seriatim, (i) a face portion extending in a plane perpendicular to the outer wall and (ii) an inner wall portion at its end extending towards the plane of the rear wall. The inner wall portions on the rear and front walls of the rails define a channel therebetween in which a peripheral portion of the panel is seated.

Desirably, the front wall of the rails has a reversely bent portion extending from an end of the inner wall portion thereof and extending towards the outer wall parallel to the plane of its face portion. A flange at the free end of the reversely bent portion is inclined towards the rear wall, and the flange bears against the panel.

DETAILED DESCRIPTION OF THE PREFERRED EMBODIMENT

Figure 1:
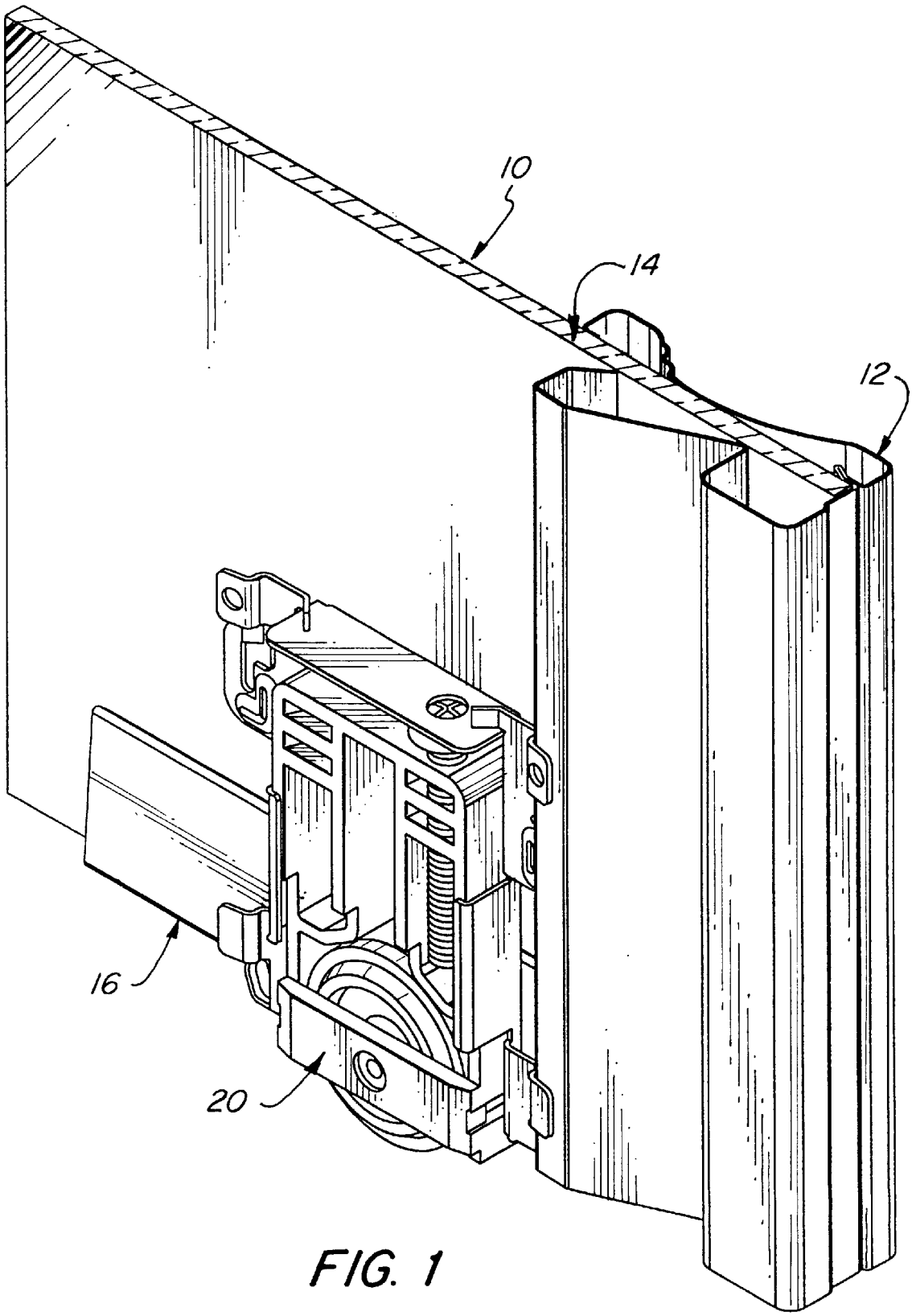
FIG. 1 is a fragmentary perspective view of a mirror door employing the gasketless frame of the present invention.
Figure 2:
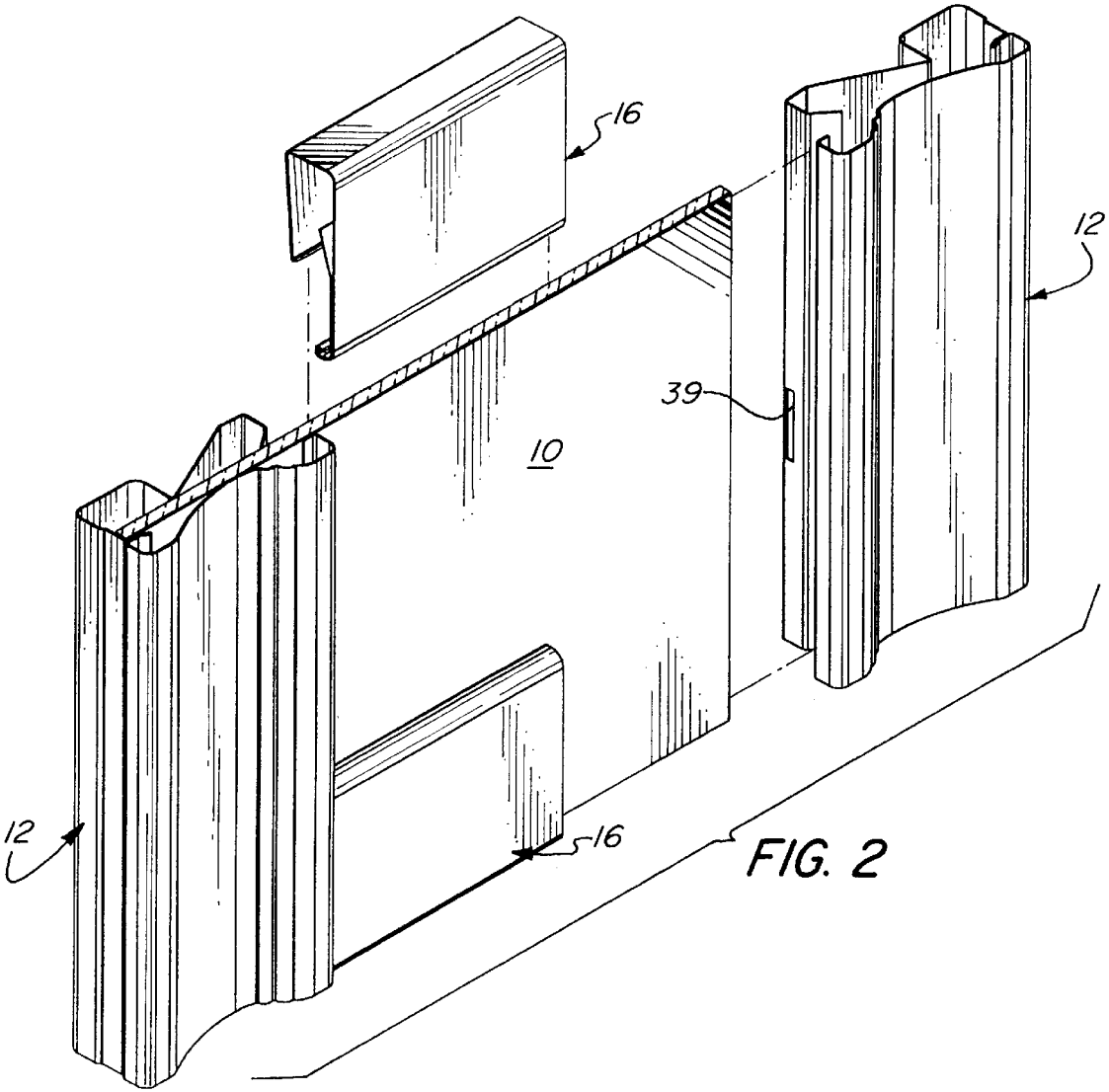
FIG. 2 is a fragmentary partially exploded view of the door without its corner connection.

Turning first to FIG. 1, therein fragmentarily illustrated is a corner of a wardrobe door employing a gasketless frame embodying the present invention. In this instance, the door is a mirror door in which a mirror panel generally designated by the numeral 10 is seated in channels 14 in the stiles, which are generally designated by the numeral 12, and in channels 18 (seen in FIG. 5) in the rails which are generally designated by the numeral 16. The stiles 12 and rails 16 together provide the perimeter frame for the door, and are assembled with corner connectors seen only in FIG. 1 and generally designated by the numeral 20.

Figure 3:
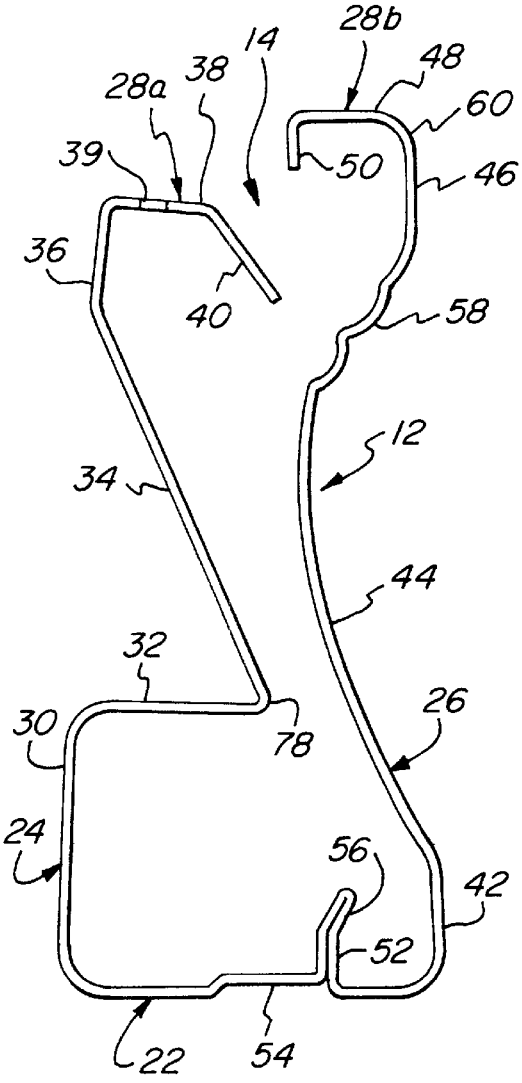
FIG. 3 is a plan view of the stile of the gasketless frame of FIG. 1 prior to insertion of the panel thereinto.
Figure 4:
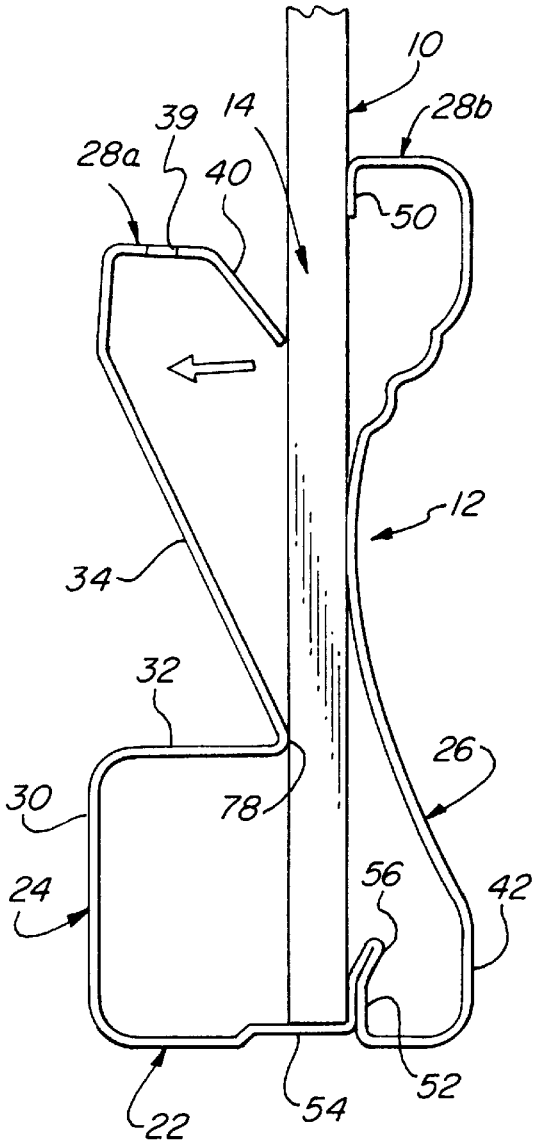
FIG. 4 is a plan view of the stile with the panel seated therein and showing the rear wall deflected by the insertion of the wall panel thereinto.

Turning first in detail to the stile 12 as seen in FIGS. 3 and 4, sheet metal is formed into a complex configuration providing an outer wall generally designated by the numeral 22, a rear wall generally designated by the numeral 24, a front wall generally designated by the numeral 26, and an inner wall comprised of sections on the rear and front walls 24,26 and designated generally by the numerals 28*a* and 28*b*.

The rear wall 24 has a base portion 30 which extends in a plane which is angled slightly from the vertical towards the front wall 26 before the panel 10 in inserted thereinto, but which extends in a plane generally perpendicular to the outer wall 22 when a panel is inserted thereinto to produce deflection of the rear wall 24. After the base portion 30 is a offset portion 32 which extends towards the front wall 26 in a plane which is generally perpendicular to the base portion 30. An intermediate portion 34 extends angularly outwardly from the front wall 26, and the face portion 36 follows and extends in generally the same plane as that of the base portion 30. As previously indicated, at its end is the inner wall portion 28*a* which includes a face section 38 extending in a plane generally perpendicular to that of the face portion 36. At the inner end of the face section 38 is a flange 40 which is angled towards the front wall 26. Adjacent the ends of the stile 12, the face section 38 has slots 39 which seat tabs (not shown) on the corner connectors 20.

The front wall 26 is comprised of the base portion 42 which extends in a plane generally perpendicular to the outer wall 22. A concave wall portion 44 extends over the major width of the front wall 26 and has an undulating section 58. The face portion 46 completes the front wall 26, and at its end is the inner wall portion 28*b* extending therefrom with a transitional arcuate section 60 therebetween. The inner wall portion 28*b* has a face section 48 which is essentially planar and extends in a plane generally perpendicular to the plane of the face portion 46. At its end is a depending flange 50 which extends in a plane generally perpendicular to the plane of the face section 48.

The outer wall 22 is configured to provide a reversely bent abutment 52 and the free end of the abutment 52 has a portion 56 which is inclined towards the front wall 26. Adjacent the reversely bent abutment 52 is an offset portion 54 in the outer wall 22.

Turning next to FIG. 4, the panel 10 has been inserted into the channel 14 between the rear and front walls 24,26 of the stile 12. As it is introduced into the channel 14, it initially abuts the flange 40 to produce deflection of the rear wall 24 about the juncture between the base portion 30 and outer wall 22. As it continues into the channel 14, it may abut the inclined section 56 and moves downwardly along the abutment 52 until it seats against the offset portion 54 of the outer wall 22. As seen in FIG. 4, the intersection 78 between the offset portion 32 and intermediate portion 34 resiliently bears against the panel 10 to hold it firmly against the front wall 26. Thus, the panel is positioned in the channel 14 by the flange 50, the flange 40, the intersection 78 and the abutment 52. The abutment 52 also firmly positions the panel 10 and stile 12 so that rocking of the stile 12 about the panel 10 is essentially precluded. As can be seen, the formerly inclined planes of the base portion 30 and face portion 36 are now essentially oriented in a common plane which is perpendicular to the plane of the outer wall 22.

Figure 5:
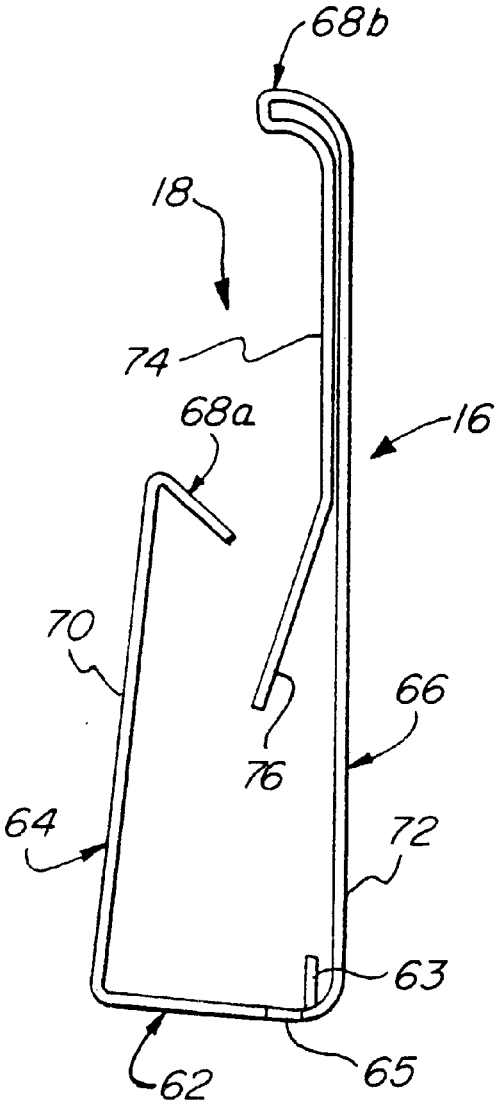
FIG. 5 is a fragmentary side elevational view of the rail of the gasketless frame of FIG. 1.
Figure 6:
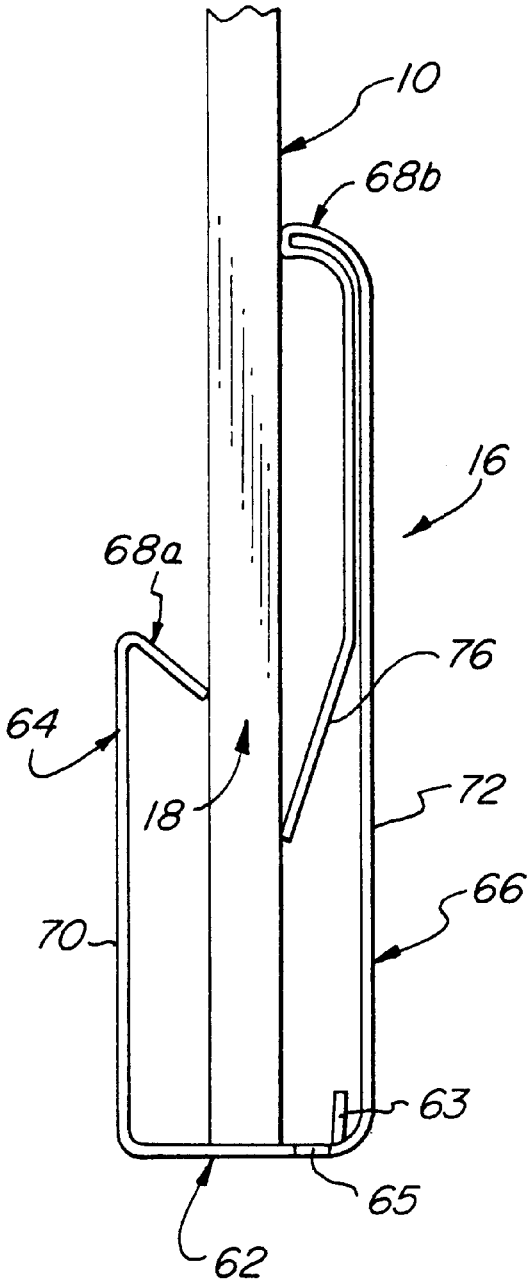
FIG. 6 is a fragmentary side elevational view of the rail with the panel seated therein and showing the rear wall deflected by the insertion of the wall panel thereinto.

Turning now to FIGS. 5 and 6, therein illustrated is the rail 16 of the present invention which has an outer wall generally designated by the numeral 62, a rear wall generally designated by the numeral 64, a front wall generally designated by the numeral 66, and inner wall portions generally designated by the numeral 68*a* and 68*b*. The outer wall 62 has an inwardly staked portion 63 adjacent its ends providing a slot 65 which seats a tab (not shown) on the corner connector 20. The rear wall 64 has a generally planar face portion 70 which extends in a plane inclined slightly towards the front wall 66 when there is no panel inserted thereinto. As seen in FIG. 6, when the panel 10 is inserted thereinto, the rear wall 64 extends in a plane generally perpendicular to the plane of the outer wall 62. At the free end of the base portion 70 is the inner wall portion 68*a* which is inclined towards the front wall 66 and outer wall 62.

The front wall 66 has a planar face portion 72 which extends in a plane generally perpendicular to the outer wall 62, and it has the inner wall portion 68*b* at its free end. As can be seen, the inner wall portion 68*b* has a reversely bent portion 74 depending therefrom which terminates in a flange which extends angularly towards the rear and outer walls 64,62.

As seen in FIG. 6, when the wall panel 10 is inserted into the channel 18, it first abuts the inner wall portion 68*a* and causes the rear wall 64 to deflect about the intersection of the walls 64,62 away from the front wall 66. As it passes thereby, it is guided in part by the flange 76 until it seats on the outer wall 62. The flexing of the rear wall 64 produces a biasing pressure exerted by the inner wall portion 68*a* to hold the panel tightly against the flange 76 and an end of the inner wall portion 68*b*. With the panel 10 fully seated therein and depending upon the thickness of the panel 10, the rear wall 64 will generally assume a position in which its plane is generally perpendicular to the plane of the outer wall 62.

The biasing action of the resiliently deflectable rear walls 24 and 64 eliminates the need for flexible synthetic resin gaskets to retain the panel 10 within the stiles 12 and rails 16. This, in turn, enables much quicker and easier assembly of wardrobe doors and a reduction in material and manufacturing costs.

The gasketless frame members are formed from sheet metal with the complex contours in a series of forming operations. The sheet metal will be in the range of 0.020–0.030 inch and preferably about 0.021–0.026 inch. By locating the principal point of the biasing pressure exerted by the rear wall relatively close to the outer wall, good mechanical advantage may be obtained.

As a specific example of gasketless framing elements, sheet metal framing elements are being made with a wall thickness of about 0.024 inch to provide a channel for a mirror panel.

The rear wall of the stile is formed with its plane at an included angle of about 88° and the plane of the face portion may be at a somewhat smaller angle. The rear wall of the rail is also formed with an initial included angle of 88°. If so desired, there may also be some small inclination of the front walls of the rails and stiles so that the insertion of the panel also produces deflection of the outer wall about its intersection with the front wall.

The references to perpendicular orientation of the portions of the front and rear walls are meant to encompass minor deviations from such perpendicularity which will occur depending upon the actual thickness of the inserted panels.

If so desired, the planar base portion of the rear wall may include a recessed portion to seat a duct strip or sealing element cooperating with the front wall of the bypassing door.

By use of the present invention, framing elements having front walls of 2–3 inches may be provided while still providing good gasketless retention.

Thus, it can be seen from the foregoing detailed description and attached drawings that the gasketless frame of the present invention effectively retains a panel without requiring the use of flexible synthetic resin gaskets, and it is readily assembled. The frame elements are readily and economically fabricated and may be formed to provide a close tolerance for the channels to receive the edge portions of the panels and provide the resilient deflection.

Having thus described the invention, what is claimed is:

1. A panel door comprising:

(a) a generally rectangular panel;

(b) a pair of elongated metallic stiles receiving side edge portions of said panel;

(c) a pair of elongated metallic rails receiving top and bottom edge portions of said panel; and (d) corner connectors each joining an end of one of said stiles to an end of one of said rails, each of said stiles and said rails being integrally formed of sheet metal with front, rear, outer and inner faces, said front face of each of said stiles having a transverse dimension that is greater than a transverse dimension of said rear face thereof, and said front face of each of said rails having a vertical dimension that is greater than a vertical dimension of said rear face thereof, each of said stiles having an outer wall constituting said outer face of said stile and also having front and rear walls extending inwardly from said outer wall of said stile which constitute said front and rear faces of said stile, respectively, said rear wall of each of said stiles having, seriatim, (i) a substantially planar base portion extending in a plane generally perpendicular to said outer wall of said stile, (ii) an offset portion extending generally perpendicularly to said plane of said base portion of said rear wall of said stile and towards said front wall of said stile, (iii) an intermediate portion extending angularly away from said front wall of said stile towards said plane of said base portion of said rear wall of said stile, and (iv) a face portion extending in said plane of said base portion of said rear wall of said stile, each of said stiles having an inner wall portion at an end of said face portion of said rear wall of said stile with (i) a face section which extends in a plane generally perpendicularly to said plane of said base portion of said rear wall of said stile and towards said front wall of said stile and (ii) a flange on said face section of said inner wall portion of said stile extending towards said front wall of said stile and angled towards said outer wall of said stile, said front wall of each of said stiles having, seriatim, (i) a base portion extending in a plane generally perpendicular to said outer wall of said stile, (ii) a concave portion extending from said front wall of said stile towards said rear wall of said stile, and (iii) a face portion extending in said plane of said base portion of said front wall of said stile, each of said stiles also having an inner wall portion at an end of said face portion of said front wall of said stile with a face section which extends in a plane generally perpendicularly to said plane of said base portion of said front wall of said stile and towards said plane of said base portion of said rear wall of said stile, said face section of said inner wall portion of said front wall of said stile having a flange extending in a plane generally perpendicularly to said plane of said face section of said front wall of said stile and towards said outer wall of said stile, each of said stiles including a channel defined by said flange of said inner wall portion of said front wall of said stile and said concave portion of said front wall of said stile cooperating with said flange on said inner wall portion of said rear wall of said stile and an intersection of said offset portion of said rear wall of said stile with said intermediate portion of said rear wall of said stile in which one of said side edge portions of said panel is seated, said rear walls of said stiles resiliently biasing said side edge portions of said panel against said front walls of said stiles.

2. The panel door in accordance with claim 1 wherein said outer wall of each of said stiles has an inwardly extending abutment provided by a reversely bent portion intermediate its width, said abutment of each of said stiles being substantially aligned with said flange of said inner wall portion on said front wall of said stile and against which said panel abuts to prevent rotational movement of said stile relative to said panel.

3. The panel door in accordance with claim 2 wherein said outer wall of each of said stiles has an inwardly offset portion adjacent said abutment of said stile upon which said panel seats.

4. The panel door in accordance with claim 2 wherein said abutment of each of said stiles has an upper section which is inclined towards said front wall of said stile.

5. The panel door in accordance with claim 1 wherein said concave portion of each of said front walls has an undulating section adjacent said face portion thereof.

6. The panel door in accordance with claim 1 wherein each of said front walls has an arcuate transitional section between said face portion of said front wall and said inner wall portion of said front wall.

7. The panel door in accordance with claim 1 wherein said rails each have an outer wall and front and rear walls extending inwardly therefrom, said rear wall of each of said rails having, seriatim (i) a face portion extending in a plane generally perpendicular to said outer wall of said rail and (ii) an inner wall portion inclined towards said front wall of said rail and said outer wall of said rail, said front wall of each of said rails having, seriatim, (i) a face portion extending in a plane generally perpendicular to said outer wall of said rail and (ii) an inner wall portion at an end of said face portion of said front wall of said rail extending towards said plane of said rear wall of said rail, each of said rails including a channel defined by said inner wall portions of said rear and front walls of said rail in which one of said top and bottom edge portions of said panel is seated.

8. The panel door in accordance with claim 7 wherein said front wall of each of said rails has a reversely bent portion extending from an end of said inner wall portion of said front wall of said rail and extending towards said outer wall of said rail parallel to the plane of the face portion of said front wall of said rail with a flange at its free end inclined towards said rear wall of said rail, said flange bearing against said panel.

9. A panel door comprising:

(a) a generally rectangular panel;

(b) a pair stile each being integrally formed of elongated sheet metal, said stiles receiving side edge portions of said panel, said stiles each having front, rear, outer and inner faces, said front face of each of said stiles having a transverse dimension which is greater than a transverse dimension of said rear face thereof, each of said stiles having an outer wall constituting said outer face of said stile and also having front and rear walls extending inwardly from said outer wall of said stile which constitute said front and rear faces of said stile, said rear wall of each of said stiles having, seriatim, (i) a substantially planar base portion extending in a plane generally perpendicular to said outer wall of said stile, (ii) an offset portion extending generally perpendicularly to said plane of said base portion of said rear wall of said stile and towards said front wall of said stile, (iii) an intermediate portion extending angularly away from said front wall of said stile towards said plane of said base portion of said rear wall of said stile, and (iv) a face portion extending in said plane of said base portion of said rear wall of said stile, each of said stiles having an inner wall portion at end of said face portion of said rear wall of said stile with (i) a face section which extends in a plane generally perpendicularly to said plane of said base portion of said stile and towards said front wall of said stile and (ii) a flange on said face section of said inner wall portion of said stile extending towards said front wall of said stile and angled towards said outer wall of said stile, said front wall of each of said stiles having, seriatim, (i) a base portion extending in a plane generally perpendicular to said outer wall of said stile, (ii) a concave portion extending from said front wall of said stile towards said rear wall of said stile, and (iii) a face portion extending in said plane of said base portion of said front wall of said stile, each of said stiles also having an inner wall portion at an end of said face portion of said front wall of said stile with a face section which extends in a plane generally perpendicularly to said plane of base portion of said front wall of said stile and towards said plane of said rear wall base portion of said stile, said face section of said inner wall portion of said front wall of said stile having a flange extending in a plane generally perpendicularly to said face section of said front wall of said stile and towards said outer wall of said stile, each of said stiles including a channel defined by said flange of said inner wall portion of said front wall of said stile and said concave portion of said front wall of said stile cooperating with said flange on said inner wall portion of said rear wall of said stile and an intersection of said rear wall offset portion of said stile and said intermediate portion of said stile in which one of said side edge portions of said panel is seated, said outer wall of each of said stiles having an inwardly extending abutment provided by a reversely bent portion intermediate its width, said abutment of each of said stiles being substantially aligned with said flange of said inner wall portion on said front wall of said stile and against which said panel abuts to prevent rotational movement of said stile relative to said panel;

(c) a pair rail each being integrally formed of sheet metal, said rails receiving top and bottom edge portions of said panel, each of said rails having an outer wall and front and rear walls extending inwardly therefrom and said front wall of each of said rails having a vertical dimension which is greater than a vertical dimension of said rear wall of said rail, said rear wall of each of said rails having, seriatim, (i) a face portion extending in a plane generally perpendicular to said outer wall of said rail and (ii) an inner wall portion inclined towards said front wall of said rail and said outer wall of said rail, said front wall of each of said rails having, seriatim, (i) a face portion extending in a plane generally perpendicular to said outer wall of said rail and (ii) an inner wall portion at an end of said face portion of said front wall of said rail extending towards said plane of said face portion said rear wall of said rail, each of said rails including a channel defined by said inner wall portions of said rear and front walls of said rail in which one of said top and bottom edge portions of said panel is seated; and (d) corner connectors each joining an end of one of said stiles to an end of one of said rails, said rear walls of said stiles and rails biasing said edge portions of said panel against said front walls said stiles and rails.

10. The panel door in accordance with claim 9 wherein said front wall of each of said rails has a reversely bent portion extending from an end of said inner wall portion of said front wall of said rail and extending towards said outer wall of said rail parallel to the plane of the face portion of said front wall of said rail with a flange at its free end inclined towards said rear wall of said rail, said flange bearing against said panel.

11. The panel door in accordance with claim 9 wherein said outer wall of each of said stiles has an inwardly offset portion adjacent said abutment of said stile upon which said panel seats, and wherein said abutment of each of said stiles has an upper section which is inclined towards said front wall of said stile.

12. Framing elements for a panel door utilizing a generally rectangular panel, comprising:

(a) stiles, each integrally formed of elongated sheet metal and for receiving side edge portions of the panel, each of said stiles having front, rear, outer and inner faces with said front face of each of said stiles having a transverse dimension that is greater than a transverse dimension of said rear face thereof, each of said stiles having an outer wall constituting said outer face of said stile and also having front and rear walls extending inwardly from said outer wall of said stile which constitute said front and rear faces of said stile, said rear wall of each of said stiles having, seriatim, (i) a substantially planar base portion extending in a plane inclined towards said front wall, (ii) an offset portion extending generally perpendicularly to said plane of said base portion of said rear wall of said stile and towards said front wall of said stile, (iii) an intermediate portion extending angularly away from said front wall of said stile towards said plane of said base portion of said rear wall of said stile, and (iv) a face portion extending in said plane of said base portion of said rear wall of said stile, each of said stiles having an inner wall portion at an end of said face portion of said rear wall of said stile with (i) a face section which extends in a plane generally perpendicularly to said plane of said base portion of said rear wall of said stile and towards said front wall of said stile and (ii) a flange on said face section of said inner wall portion of said stile extending towards said front wall of said stile and angled towards said outer wall of said stile, said front wall of each of said stiles having, seriatim, (i) a base portion extending in a plane generally perpendicular to said outer wall of said stile, (ii) a concave portion extending from said front wall of said stile towards said rear wall of said stile, and (iii) a face portion extending in said plane of said base portion of said front wall of said stile, each of said stiles also having an inner wall portion at an end of said face portion of said front wall of said stile with a face section which extends in a plane generally perpendicularly to said plane of said base portion of said front wall of said stile and towards said plane of said rear wall base portion of said stile, said face section of said inner wall portion of said front wall of said stile having a flange extending in a plane generally perpendicularly to said face section of said front wall of said stile and towards said outer wall of said stile, each of said stiles including a channel defined by said flange of said inner wall portion of said front wall of said stile and said concave portion of said front wall of said stile cooperating with said flange on said inner wall portion of said rear wall of said stile and an intersection of said rear wall offset portion of said stile and said intermediate portion of said stile in which one of the side edge portions of the panel is adapted to be seated, said rear walls of said stiles being adapted to resiliently bias the side edge portions of the panel against said front walls of said stiles;

(b) rails, each integrally formed of sheet metal and having front, rear, outer and inner faces for receiving top and bottom edge portions of the panel, each of said rails having an outer wall and front and rear walls extending inwardly therefrom, said front wall of each of said rails having a vertical dimension which is greater than a vertical dimension of said rear wall of said rail, said rear wall of each of said rails having, seriatim, (i) a face portion extending in a plane inclined towards said front wall of said rail and (ii) an inner wall portion inclined towards said front wall of said rail and said outer wall of said rail, said front wall of each of said rails having, seriatim, (i) a face portion extending in a plane generally perpendicular to said outer wall of said rail and (ii) an inner wall portion at an end of said face portion of said front wall of said rail extending towards said plane of said rear wall of said rail, each of said rails including a channel defined by said inner wall portions of said rear and front walls of said rail in which one of the top and bottom edge portions of the panel is adapted to be seated, said rear walls of said rails being adapted to resiliently bias the top and bottom edge portions of said panel against said front walls of said rails; and (c) corner connectors for joining ends of said stiles to end of said rails.

13. The framing elements in accordance with claim 12 wherein said outer wall of each said stiles has an inwardly extending abutment provided by a reversely bent portion intermediate its width, said abutment of each of said stiles being substantially aligned with said flange of said inner wall portion on said front wall of said stile and against which the panel is adapted to abut to prevent rotational movement of said stile relative to the panel.

14. The framing elements in accordance with claim 13 wherein said outer wall of each of said stiles has an inwardly offset portion adjacent said abutment of said stile, and said abutment of each of said stiles has an upper section which is inclined towards said front wall of said stile.

15. The framing elements in accordance with claim 12 wherein said front wall of each of said rails has a reversely bent portion extending from an end of said inner wall portion of said front wall of said rail and extending towards said outer wall of said rail parallel to the plane of the face portion of the front wall of said rail with a flange at its free end inclined towards said rear wall of said rail, said flange being adapted to bear against the panel.

* * * * *